United States Patent [19]

Monk

[11] 4,383,579

[45] May 17, 1983

[54] SHOCK ACTUATED FIRE PREVENTION SYSTEM FOR AUTOMOBILES

[76] Inventor: Guerdon M. Monk, G 8314 Davison Rd., Davison, Mich. 48423

[21] Appl. No.: 379,464

[22] Filed: May 18, 1982

Related U.S. Application Data

[63] Continuation-in-part of Ser. No. 152,330, May 22, 1980, abandoned.

[51] Int. Cl.[3] ..... A62C 35/12

[52] U.S. Cl. ..... 169/62; 169/14; 252/3

[58] Field of Search ..... 16/14, 15, 19, 20, 42, 16/57, 58, 62; 252/3, 8.05; 169/9, 11

[56] References Cited

U.S. PATENT DOCUMENTS

| | | | |
|---|---|---|---|
| 1,067,803 | 7/1913 | Daniel | 169/62 X |
| 1,660,992 | 2/1928 | Erwin | 169/62 |
| 1,856,575 | 5/1932 | Martin | 169/62 X |
| 1,953,582 | 4/1934 | Belknap | 169/42 |
| 2,338,440 | 1/1944 | Kochmann | 169/58 |
| 3,457,172 | 7/1969 | Ferguson et al. | 252/3 |
| 3,465,827 | 9/1969 | Levy et al. | 169/5 X |
| 3,479,285 | 11/1969 | Barthauer | 252/3 |
| 3,738,428 | 6/1973 | Ingro | 169/61 |
| 3,876,011 | 4/1975 | Poitras | 169/57 |

*Primary Examiner*—Gil Weidenfeld
*Assistant Examiner*—Fred A. Silverberg
*Attorney, Agent, or Firm*—Harry R. Dumont

[57] ABSTRACT

A portable foam generator system adaptable for use in any vehicle, land, sea or air. A plurality of separate trip zones are provided in the vehicle in the passenger compartment, engine compartment, fuel tank compartment and in other critical zones. When one of the vehicle trip zones receives a shock, there will be opened a ball valve to cause a mixing flow of water and foam which will exit through a foam line to the zone or zones provided. Each such zone includes a plurality of foam outlet nozzles selectively directed to provide maximum effective distribution of the foam. The particular foam used is a high expanding foam with non-flammable ingredients and including preferably a propanol solvent. The foam is such that it can be breathed and at the same time it protects passengers from flames. Dissipation of the foam after evacuation of the system is done without damage to articles or goods in the vehicle.

4 Claims, 4 Drawing Figures

TRIP LINES

FOAM LINES

AIR TANK & LINES & AIR REGULATOR

WATER REFILL & TANKS & LINES

SHOCK ACTUATED FIRE PREVENTION SYSTEM FOR AUTOMOBILES

REFERENCE TO RELATED APPLICATION

This application is a continuation-in-part of my application Ser. No. 152,330 filed on May 22, 1980, now abandoned, for "SHOCK ACTUATED FIRE PREVENTION SYSTEM FOR AUTOMOBILES"

BACKGROUND OF THE INVENTION

Prior art fire prevention systems used in vehicles are known which provide shock actuated devices to initiate the operation of the system. U.S. Pat. No. 2,338,440, issued to W. Kochman, on Jan. 4, 1944 for "FIRE EXTINGUISHING AND PREVENTING SYSTEM FOR MOTOR VEHICLES" is of interest in this regard. It does not however provide a foam generation action from a number of different points in the vehicles as provided by the present invention.

U.S. Pat. No. 3,876,011 issued to E. J. Poitras, on Apr. 8, 1975 for "APPARATUS FOR PREVENTING AND EXTINGUISHING AUTOMOBILE FIRES" is of interest but the system shown is primarily directed and limited to a fire inhibiting liquid which is directed to coat the fuel tank and prevent its ignition.

U.S. Pat. No. 3,738,428 issued to Ben Ingro on June 12, 1973 for "SAFETY FUEL TANKS" relates to a specialized fire extinguishing system for tank trucks. While a fire foam is automatically dispensed, it is limited to a localized and specialized tank area on the tank truck.

U.S. Pat. No. 1,660,992 issued to O. R. Erwin on Feb. 28, 1928 for "FIRE EXTINGUISHING APPARATUS". This patent relates to a foam system in which the foam generation is provided in a closed system with a number of mixing chambers distributed throughout the engine compartment. The single valve means is used to provide communication between the various chambers and the mixing chambers.

None of the prior art systems shows a portable foam generator like the one provided by the instant invention which acts not only to extinguish the fire once started, but also provides for prevention of fires after each collision which might occur.

The system is further readily adaptable to any vehicle and involves only a limited amount of space to be used, for example in the luggage compartment of the vehicle.

SUMMARY OF THE INVENTION

The present invention relates to a foam generator system which not only extinguishes but eliminates the possibility of a fire once a collision has occurred involving the vehicle. The foam generated is such that it can be breathed by a passenger and further will not damage the interior of the car or other vehicle. The foam will also dissipate once the fire is out and the emergency over with no resultant damage to be cleaned.

BRIEF DESCRIPTION OF THE DRAWINGS

The above noted objects and features of the present invention will become more apparent upon consideration of the following description taken in conjunction with the accompanying drawings in which like numbers are used to refer to like elements as they may occur in the different drawings and wherein.

DETAILED DESCRIPTION OF THE PREFERRED EMBODIMENT

Figure 1:
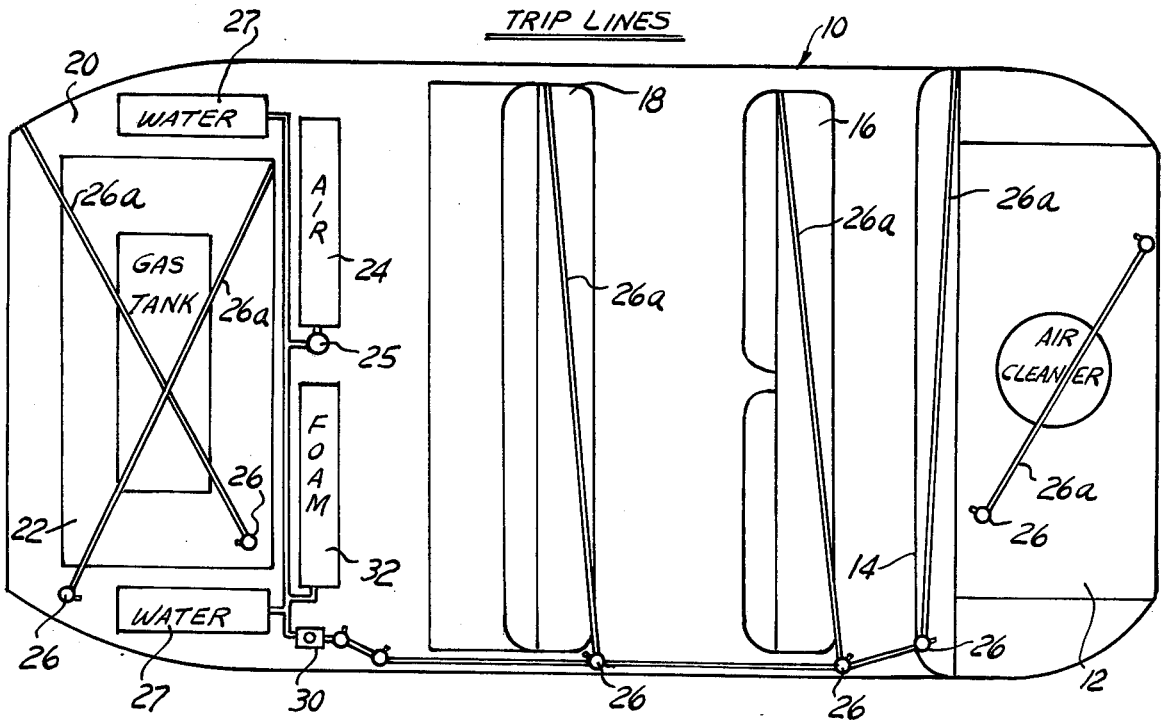
FIG. 1 is a schematic plan view of the vehicle system showing the trip lines and trip valve arrangement for actuating it.

As shown in FIG. 1, the vehicle 10 includes a number of compartments or zones each of which comprises a separate trip zone in the system. These include the motor compartment 12, the dash compartment 14, the front seat zone 18, the trunk compartment 20 the gas tank zone 22. The pressurized vessel or air tank 24 and the resovoirs-water tank 24 and foam tank 32 are located in the the trunk compartment 20. The several trip zones each include a spring loaded ball trip valve 26 which when activated will release the air pressure valve 25 associated with the air tank 24. FIG. 1 also shows the several trip lines *26a*, each of which is associated with a trip valve of the shock actuated type 26. The trip lines *26a* are preferably made of beryllium copper strip comprising separate sections of strip fused together at equally spaced intervals by tin-lead rosin cores solder points.

Figure 2:
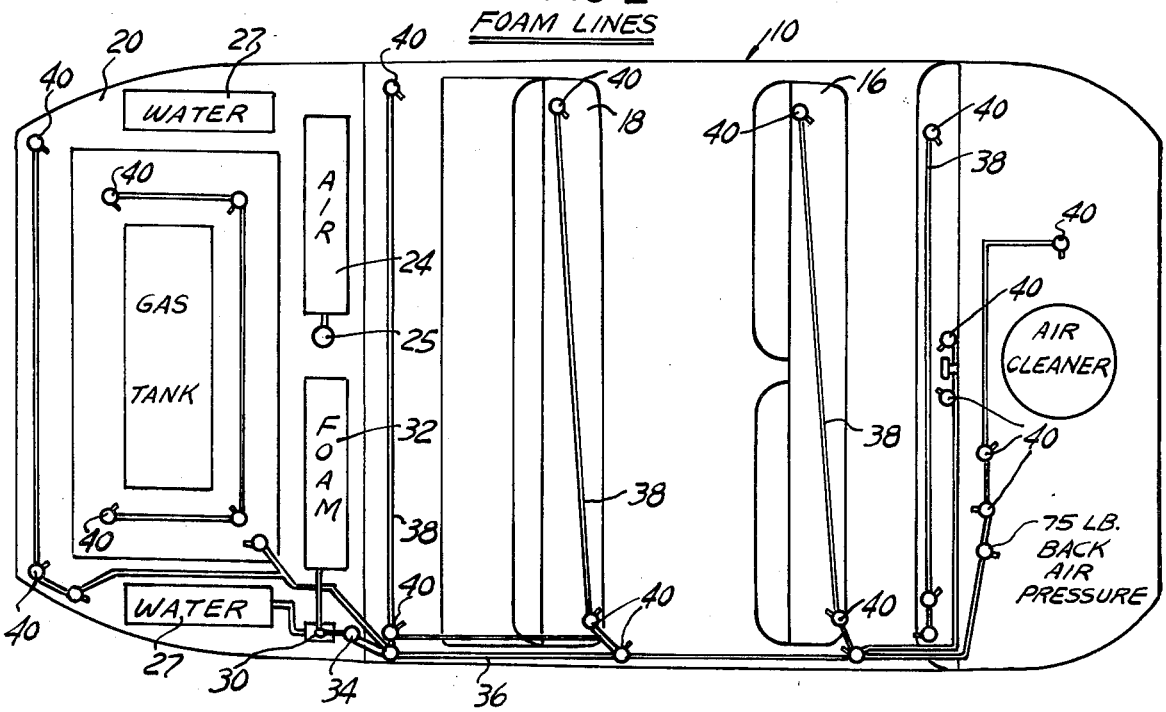
FIG. 2 is a schematic showing of the invention showing the foam lines and their outlets in the several trip zones of the vehicle.
Figure 3:
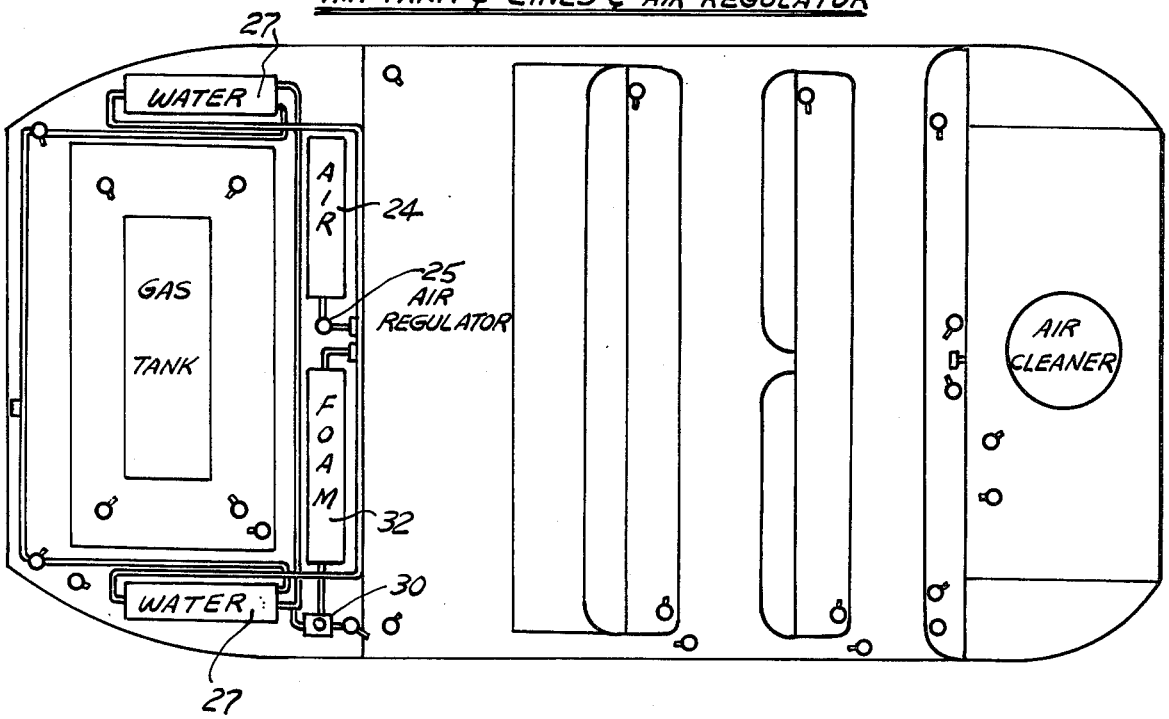
FIG. 3 is a further schematic view showing the compressed air system and its relationship to the remainder of the fire protection system.

The air pressure valve 25 will release a flow of pressurized air of the order of 75 PSI as best shown in FIG. 3. The water from tank 27 will start to flow into a mixing valve 30 as best shown in FIG. 2. When the water starts its flow, the foam from foam tank 32 will also run through a check valve 34, a conduit 36 and branches 38. A plurality of outlet nozzles 40 are included to selectively direct the flow of pressurized foam within each of the different critical zones and compartments. FIG. 2 also shows a source of approximately 75 PSI back air pressure that will hold the foam back until one of the trip valves 26 are tripped.

After operation of the fire prevention system, the foam that has been released in the several compartments may be removed simply by blowing it from inside the compartment out the vehicle doors by fans or air hose. A preferred foam concentrate to be used in connection with the present invention is the foam known as "Hi-Ex". This material is manufactured and sold by Kidde Belleville, a division of Walter Kidde & Company, Inc., 675 Main Street, Belleville, New Jersey 07109. The data relative to this foam concentrate is as follows:

pH 6.5–7.0 Viscosity 13.5 centistrokes at 70° F. specific gravity 1.003 Temperature limits 35° F. to 110° F.

Major ingredients of this material or others of a similar nature also currently commercially available are as follows;

Sulphated biodegradable surfactant Alcohol (non-flammable) Propanol type solvent Also of importance in the system are air pressure valves 26 which comprise spring loaded ball valves. One example of a valve suitable for use in this system is the series 125 T ball valve manufactured by the Smith Valve Company. It will be seen that the system according to the present invention makes it possible not only to inhibit a fire that may be started by collision but also to prevent one from occurring after the event. Further detail of the air pressure lines shown are associated with the water tanks 27 and these are all of course controlled in their operation by the trip valves 26 of FIG. 1.

Figure 4:
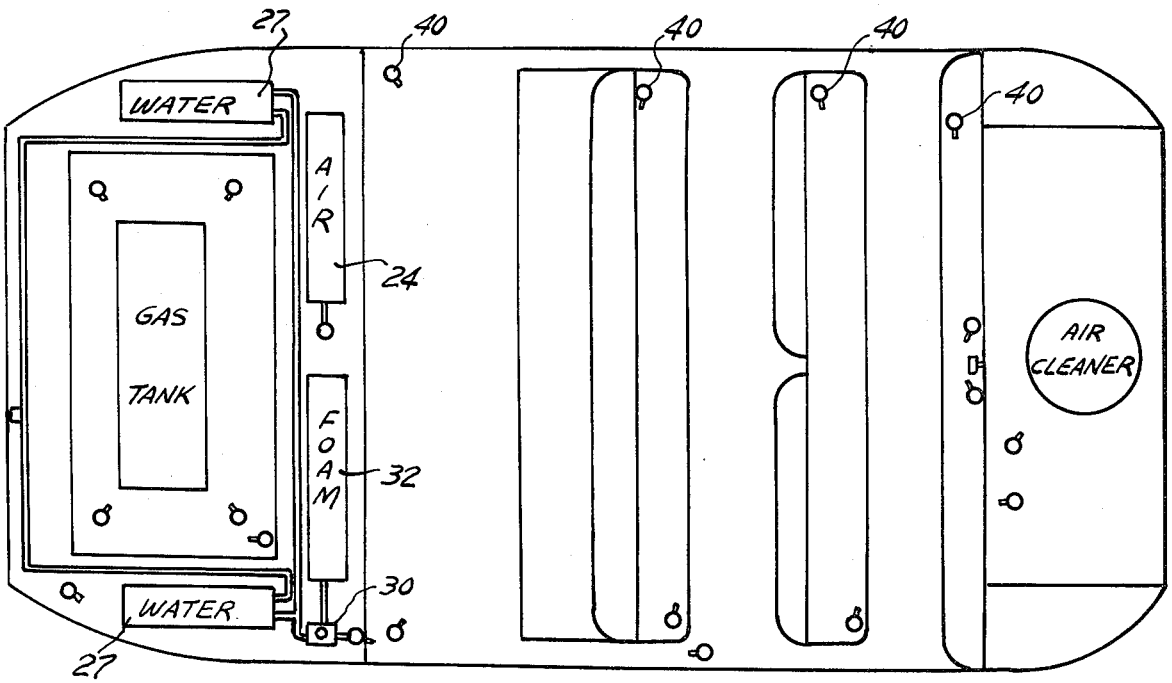
FIG. 4 is a further schematic showing of the invention illustrating the water refill and circulation system.

FIG. 4 shows the basic parts of the water refill and tank system including tanks 27 and the fill pipe at the lefthand side of the figure.

Once again, it will be understood that the flow of water to the mixing valve 30 for admixture with the foam concentrate from foam tank 32 is accomplished responsive to the actuation of the trip valves 26 and to the change of pressure from pressurized air tank 24.

In each zone as soon as the high pressure (of the order of 75 PSI) is released, the low pressure (of the order of 55 PSI) begins to operate on the water and foam and the mixing starts in the mixing valve 30. The valve 30 is a proportional valve which admits a predetermined proportion of water and foam and emits the mixture according to that proportion. One type of valve suitable for commercial use is mixing valve 206A manufactured and sold by DEMA of St. Louis, Missouri. When one of the trip valves 26 is actuated, it allows the mixture of water from one of tanks 27 and foam from one of the foam tanks 32 to pass from the mixing valve 30, into the master line 36 and junction valves 38 and then through the guns 40.

I claim:

1. A fire prevention system for a vehicle divided into a plurality of compartments and zones, comprising:

a trip valve operatively mounted in each of said zones and actuable responsive to shock received in one of said compartments and zones;

a reservoir of water;

a reservoir of high expanding foam concentrate;

a pressurized vessel operatively connected to and controlling the mixture of water and concentrate from said reservoirs;

a mixing valve operative to receive and mix a flow output from said two reservoirs responsive to the actuation of said trip valves and the release of air pressure from said vessel;

a plurality of conduits each communicating between said mixing valve and different ones of said zones; said trip value releasing pressurized air which is initially stored in the conduits;

and a plurality of outlet nozzles, each operatively connected to one of said conduits and mounted in a different one of said zones for providing output of high expanding foam to said zones responsive to shock in any one of said zones, said high expanding foam concentrate including a plurality of non-flammable ingredients and a propanol solvent such that it can be breathed and at the same time protect passengers from flames.

2. The combination as set forth in claim 1 wherein said zones and compartments include the fuel tank zone, the passenger compartment, and the engine of said vehicle.

3. The combination as set forth in claim 1 wherein said reservoirs and said vessel are all mounted in the luggage compartment of said vehicle and a further plurality of said nozzles are further mounted therein for dissipating said foam in that compartment.

4. The combination as set forth in claim 1 wherein said non-flammable ingredients includes a sulfated biodegradable surfactant and a non-flammable alcohol.

* * * * *